United States Patent [19]

Przybyla et al.

[11] Patent Number: 4,612,790

[45] Date of Patent: Sep. 23, 1986

[54] METHOD OF DRAWING RIBS ON TUBES

[75] Inventors: Janusz Przybyła, Zabkowice Bedzińskie; Zygmunt Goździewicz, Kedzierzyn-Koźle; Andrzej Szal, Kedzierzyn-Koźle; Ryszard Zub, Kedzierzyn-Koźle; Andrzej Maczyński, Gliwice, all of Poland

[73] Assignee: Zaklady Urzadzen Chemicznych Metalchem, Kedzierzyn-Koźle, Poland

[21] Appl. No.: 622,193

[22] Filed: Jun. 19, 1984

[51] Int. Cl.[4] ..... B21D 53/06

[52] U.S. Cl. ..... 72/96; 72/98; 72/370

[58] Field of Search ..... 72/78, 95, 96, 98, 370; 29/157.3 AH

[56] References Cited

U.S. PATENT DOCUMENTS 2,337,490 12/1943 Penner ..... 72/96

3,461,701 8/1969 Marcovitch ..... 72/101

4,153,982 5/1979 Przybyla et al. ..... 72/98

*Primary Examiner*—Lowell A. Larson

*Attorney, Agent, or Firm*—Ladas & Parry

[57] ABSTRACT

A method of forming ribs on tubes or pipes is characterized by applying to the material of the tube, from which the rib is formed, initial compressive stresses preferably $$(0.2 - 0.7)\frac{Fo - Fr}{Fo} \cdot Re,$$

where Fo denotes the area of the cross-section of the tube before drawing, Fr denotes the area of the cross-section of the core of the tube after drawing the rib, and Re is the plasticity limit. Next, ribs are drawn by driven tools with roll-formed disks while maintaining said compressive stress.

3 Claims, 4 Drawing Figures

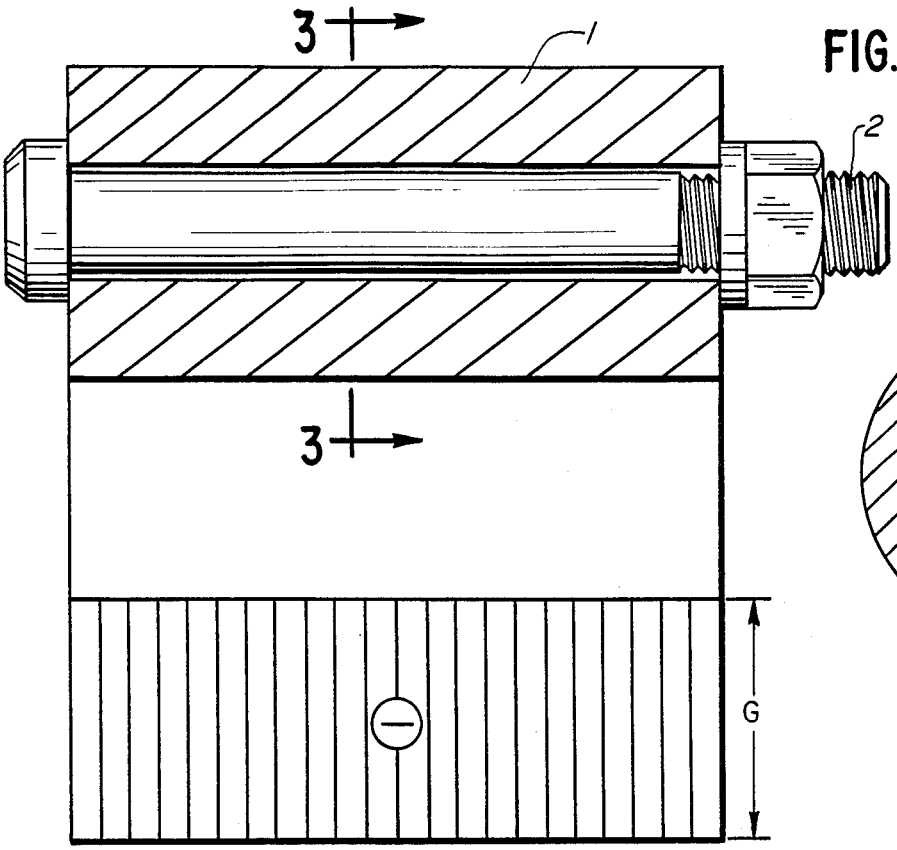
FIG. 1
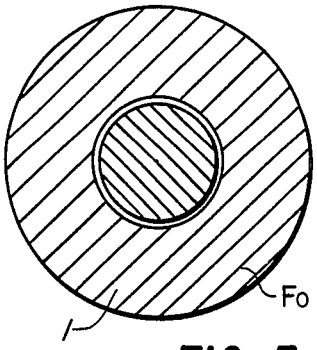
FIG. 3
FIG. 2
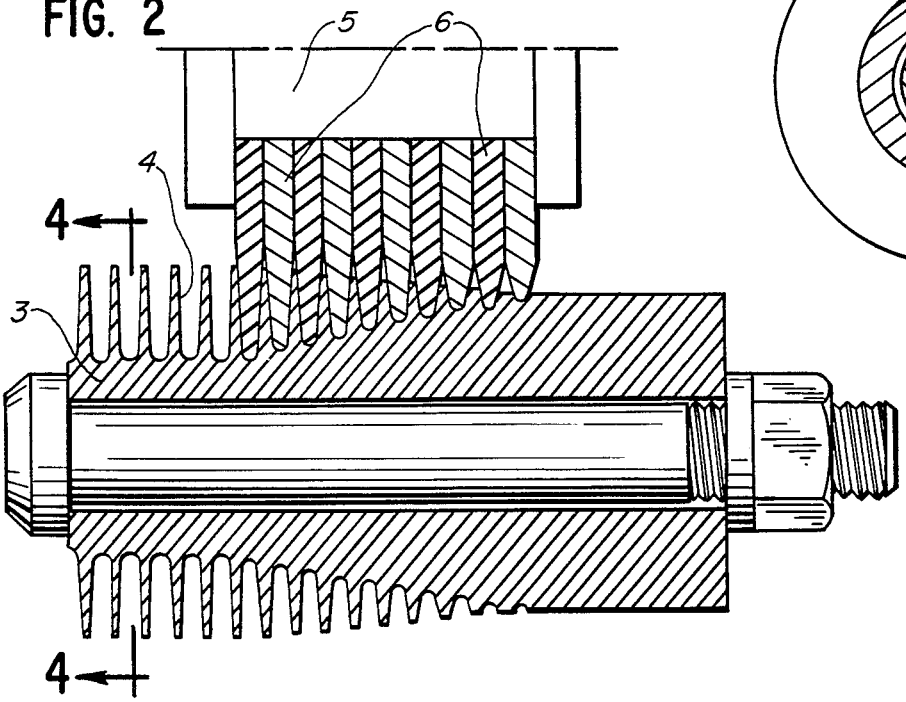
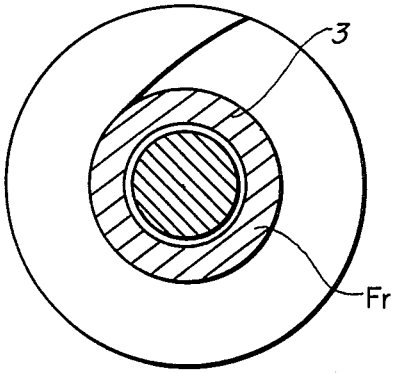
FIG. 4

METHOD OF DRAWING RIBS ON TUBES

BACKGROUND OF THE INVENTION

The subject of the invention is a method of forming ribs on pipes or tubes, especially ribs of small pitches or ribs on tubes of low-plastic materials.

Hitherto, production of ribs on tubes by the drawing method, called also the rolling method, has been carried out in heads comprising usually three symmetrically arranged cylinders composed of a series of roll-formed disks. The axis of each cylinder forms with the axis of rolling, which is the axis of the tube, a constant angle. The value of the said angle results from the geometrical dependencies of the helical outline of ribs drawn on the tube. Cylinders are driven with rotary motion, due to which, after introducing the tube into the zone of the action thereof, the cylinders transmitting the rotary motion to the tube draw the rib. Forming the ribs on the tube is the result of producing in the zone of the action of the tool a corresponding state of stresses in the material of the tube, causing a plastic strain. The material of the tube deforms in the zone of the action of the tool in the axial and radial direction. Radial strain manifests itself in a form of increasing the diameter of ribs, and axial strain manifests itself in a form of elongation of the tube. Elongation of the tube in the process of drawing the ribs is a disadvantageous phenomenon because the quantity of the elongation is random variable for each segment of the tube. This characteristic causes the necessity of applying technological allowances, and thus, production of wastes. Axial strains of the tube are caused by corresponding axial stresses induced by the tool in the zone of its operation. As a result of the action of the said stresses the tool is subject to very high loads in the axial direction. The said loads cause bending out the disks of which the tool consists. As a result thereof the pitch of ribs is not uniform and always greater than the pitch of the disks. The substantial problem in the hitherto applied methods of drawing the ribs is a low durability of the tool whose disks are destroyed in the result of the action of bending loads of a fatigue character.

The Polish patent specification No. 113419 presents the design of a tool with the use of an additional disk stiffening the tool and increasing its durability. Such a solution does not eliminate, however, the elongation of the tube and it is difficult to draw ribs of very small pitches on tubes of materials having high resistance to plastic strain because the increase of loads in the axial direction of the tool is considerably greater than the possibility of increasing the rigidity of the tool.

The U.S. Pat. No. 3,876,593 presents a method of producing bimetallic ribbed tubes with the application of blocking the possibility of elongation of the tube on which ribs are drawn. This blocking consists in clamping the end of the external tube on the internal tube, and then the drawing process starts from the second, free end of the tube. During drawing ribs by the said method different values of axial stresses are observed along the length of the tube. In the initial stage, when starting drawing the ribs from the free end of the tube, axial stresses in the non-deformed part of the tube grow systematically till reaching a definite state of equilibrium of stresses in the material of the external tube. At the same time, as a result of increasing axial stresses, in the external tube, from the value "0" at the beginning to the value corresponding to the state of equilibrium, the diameter of ribs increases from a certain initial quantity to the required quantity. The segment of the tube with different diameters of ribs usually does not meet the requirements imposed to dimensional tolerances and is a waste material. A disadvantageous phenomenon in the first stage of drawing is also the excessive bending load of the disks of the tool.

SUMMARY OF THE INVENTION

The essence of the method of forming ribs on tubes or pipes according to the invention consists in that, to the material of the pipe from which ribs are formed by rotating tools, initial compressive stress is introduced, of a quantity less than the plasticity limit or yield point Re of the material of the pipe, and then in the work zone of rotating disk tools, with maintenance of the initial compressive stress in the material of the pipe, ribs are roll formed by pressing down onto the tube driven disk tools with axes set at an angle to enable the pipe to move axially. It is preferable that the initial compressive stress is $$(0.2 - 0.7)\frac{Fo - Fr}{Fo} Re,$$

where Fo denotes the size of the area of the section of the pipe, and Fr denotes the size of the area of the section of the core of the pipe, after drawing the rib. By introducing the initial state of compressive stresses to the material of and by maintaining said compressive stress during the rib forming cycle, the tool is relieved from loads along the axis, bending out the roll-formed disks, practically already in the first stage of the contact of the tool with the material. Another effect of introducing the initial state of compressive stresses is the avoidance of the axial elongation of the tube. In these conditions the work of the tool resolves itself to inducing plastic strains of the tube in the radial direction.

By realizing the production of ribbed tubes with the disclosed method tubes of a constant geometry over the whole length are obtained, with maintenance of the high service life of tools. By means of the tool relieved from harmful bending stresses it is possible to draw ribs of very small pitches and greater heights, from materials having high plasticity limits.

BRIEF DESCRIPTION OF THE DRAWINGS

The method of drawing ribs on tubes or pipes according to the invention is presented in more detail in the drawings, wherein FIG. 1 shows the tube clamped with a screw and the diagram of compressive stresses of the said tube, FIG. 2 is the axial section through the tube and the tool in the course of drawing ribs, FIG. 3 is the cross-section through the tube before the operation of drawing ribs, and FIG. 4 is the cross-section through the tube after drawing ribs.

DETAILED DESCRIPTION

The tube 1 before the operation of drawing ribs has been clamped at each end with a screw 2, thus inducing the origination of an initial compressive stress of an established quantity. The quantity of the said stress is preferably $$(0.2 - 0.7)\frac{Fo - Fr}{Fo} \cdot Re,$$

where Fo is the size of the area of the cross-section of the tube before the drawing operation, Fr is the size of the area of the cross-section of the core of the tube 3 after the operation of drawing the rib 4, and Re is the plasticity limit of the material of the tube. After initial clamping the tube 1 with the screw 2, the tube is introduced into the zone of the action of driven tools 5 provided with roll-formed disks 6. During drawing of ribs 4 axial stresses practically do not act on the disks 6, which enables obtaining very small pitches of ribs, and the material of the tube is subject to plastic strains only in the radial direction.

We claim:

1. A method of forming ribs on pipes by means of rotating tools comprising formed discs, characterized in that initial compression stresses of a magnitude lower than that of the yield point of the pipe material are applied to the material of the pipe on which ribs are formed and, next the so-formed pipe is compressed by means of driven discs with their axes set at an angle until axial movement of the pipe has been caused and ribs of the shape resulting from that of the formed discs of the rotating tools have been formed under that pressure, that said initial compression stresses being retained in the pipe material throughout the entire rib forming cycle.

2. A method according to claim 1, characterized in that the quantity of the initial compressive stress is $$(0.2 - 0.7)\frac{Fo - Fr}{Fo} Re,$$

where Fo denotes the size of the area of the cross-section of the pipe before forming, and Fr denotes the size of the area of the cross-section of the core of the pipe after forming the rib.

3. A method according to claim 1, characterized in that said initial compression stresses are applied to the pipe material by extending a screw placed inside it and clamping both ends on the pipe material.

* * * * *